US006701853B1

(12) United States Patent
Hwang

(10) Patent No.: US 6,701,853 B1
(45) Date of Patent: Mar. 9, 2004

(54) HEIGHT-ADJUSTABLE TABLE

(76) Inventor: Sunny Hwang, 20427 Corsair Blvd., Hayward, CA (US) 94545

( * ) Notice: Subject to any disclaimer, the term of this patent is extended or adjusted under 35 U.S.C. 154(b) by 0 days.

(21) Appl. No.: 10/233,390

(22) Filed: Sep. 3, 2002

(51) Int. Cl.[7] ..... A47B 9/00
(52) U.S. Cl. ..... 108/118
(58) Field of Search ..... 108/118, 119, 108/120, 145; 254/122; 248/631, 622; 2/432, 164, 188.2

(56) References Cited

U.S. PATENT DOCUMENTS

| | | | | | |
|---|---|---|---|---|---|
| 264,458 | A | | 9/1882 | Johnson | |
| 1,318,564 | A | * | 10/1919 | Jenkins | 108/145 |
| 1,982,205 | A | * | 11/1934 | Doman | 108/117 |
| 2,557,594 | A | * | 6/1951 | Bryan | 108/118 |
| 2,630,359 | A | | 3/1953 | Schade | |
| 3,152,833 | A | * | 10/1964 | Creveling et al. | 297/140 |
| 3,888,451 | A | | 6/1975 | Lacey | |
| 4,194,452 | A | | 3/1980 | Crowther et al. | |
| 4,249,749 | A | * | 2/1981 | Collier | 280/35 |
| 4,273,306 | A | | 6/1981 | Chang | |
| 4,492,170 | A | | 1/1985 | Solomon | |
| 4,515,087 | A | | 5/1985 | Kurrasch | |
| 4,558,648 | A | * | 12/1985 | Franklin et al. | 108/147 |
| 4,809,685 | A | | 3/1989 | Barnes | |
| 4,843,978 | A | | 7/1989 | Schmidt et al. | |
| 4,926,760 | A | * | 5/1990 | Sack | 108/145 |
| 5,503,086 | A | | 4/1996 | Hoffman et al. | |
| 5,588,377 | A | * | 12/1996 | Fahmian | 108/145 |
| 5,743,193 | A | | 4/1998 | Kakuta et al. | |
| 5,893,182 | A | | 4/1999 | Sutherland et al. | |

* cited by examiner

*Primary Examiner*—Jose V. Chen
(74) *Attorney, Agent, or Firm*—Christopher J. Whewell; Western Patent Group

(57) ABSTRACT

The present disclosure provides tables having a tabletop whose height is adjustable. A table according to the present disclosure is useful among other employments as a coffee table whose height can be varied to suit the needs of persons using the table for various purposes, including game playing. A table with adjustable height top portion according to the disclosure attractive and functional. Various structures for maintaining the selected height at which the table top is set are disclosed.

5 Claims, 15 Drawing Sheets

HEIGHT-ADJUSTABLE TABLE

FIELD OF THE INVENTION

This invention relates to furniture, and more particularly to tables, and especially to tables whose top portion is adjustable in height.

BACKGROUND

Tables have been known since the most ancient times. In general, tables may take on the roles of either a functional surface upon which various articles, implements, decorations, etc. may be placed, or are decorative in nature or both. Most common persons desiring to add a table to their existing decor will look to conventional suppliers of tables, and make their selection based upon the tables which are available from these suppliers. Oftentimes, a compromise must be made between functionality and appearances, since it is desirable in most home environments to first and foremost have a table which matches the decor in the room in which the table is intended to reside. However, table manufacturers do not in general offer tables of the same outer appearance having table top portions disposed at various height levels from the floor upon which the table rests, but rather have adopted in the industry standard heights. Thus, if a person were desirous of having a table which matched their decor in the room selected for the table which table also had a specific height, such a table would not be readily available and would probably need to be custom fabricated.

In addition, it is not always desirable to have the tabletop of a table disposed at the same height with respect to the floor on which the table as a whole resides, but convenience would require the height of the table top to be adjustable with respect to the floor level. Being able to alter the height of the table top of a table adds versatility to the overall functionality of a table.

It is thus an object of the present invention to provide a table having a top portion whose height level is adjustable. It is also an object of the present invention to provide a height-adjustable table whose height may be varied with a minimal amount of force by the user, through the use of biasing springs. It is also an object of the present invention to provide a height-adjustable table which can be locked in place in any height desired by the user. These and other objects and advantages are provided by the present invention.

SUMMARY OF THE INVENTION

The present invention provides a height-adjustable table comprising a base portion having length, width, and height dimensions, and comprising a top portion, bottom portion, two face portions, and two end portions. There is a track means disposed on the top portion of the base portion, wherein the track means comprises a first linear track member and a second linear track member, wherein the track members are oriented parallel to one another, and wherein each of the track members include a slot, wherein the slot on the first linear track member and the slot on the second linear track member are oriented in a parallel configuration with respect to one another. There is a scissoring support means which comprises: i) a linear first pivoting support having an upper end portion and a lower end portion; ii) a linear first slidable pivoting support having an upper end portion and a lower end portion; iii) a linear second pivoting support having an upper end portion and a lower end portion; iv) a linear second slidable pivoting support having an upper end portion and a lower end portion. The first pivoting support and the second pivoting support are connected to one another at their upper end portions by means of a linear upper pivoting support connector and wherein the first pivoting support and the second pivoting support are connected to one another at their lower end portions by means of a linear lower pivoting support connector. The first slidable pivoting support and the second slidable pivoting support are connected to one another at their upper end portions by means of a linear upper slidable pivoting support connector and wherein the first slidable pivoting support and the second slidable pivoting support are connected to one another at their lower end portions by means of a linear lower slidable pivoting support connector. The first pivoting support and the first slidable pivoting support are pivotally connected to one another at a point along their lengths, and the second pivoting support and the second slidable pivoting support are pivotally connected to one another at a point along their lengths. The first and second slidable pivoting supports each have a pin disposed at their lower end portions which pins engage into the slots of the linear track members. There is a platen which comprises a first platen width support, a first platen length support, a second platen width support, and a second platen length support, wherein the width supports are oriented parallel to one another, the first platen width support and the second platen width support each including a slot disposed in their face portion which faces the interior space between them, the platen being hingedly connected to the upper end portions of the first pivoting support and the second pivoting support, and wherein the first and second slidable pivoting supports each further comprise a pin disposed at their upper end portions, which pins engage into the slots of the first platen width support and the second platen width support. There is a table top portion, the table top portion being attached to the platen. A table according to the invention also includes a means for maintaining the platen at a selected height above the top portion of the base portion, as further described herein.

DETAILED DESCRIPTION

Figure 1:
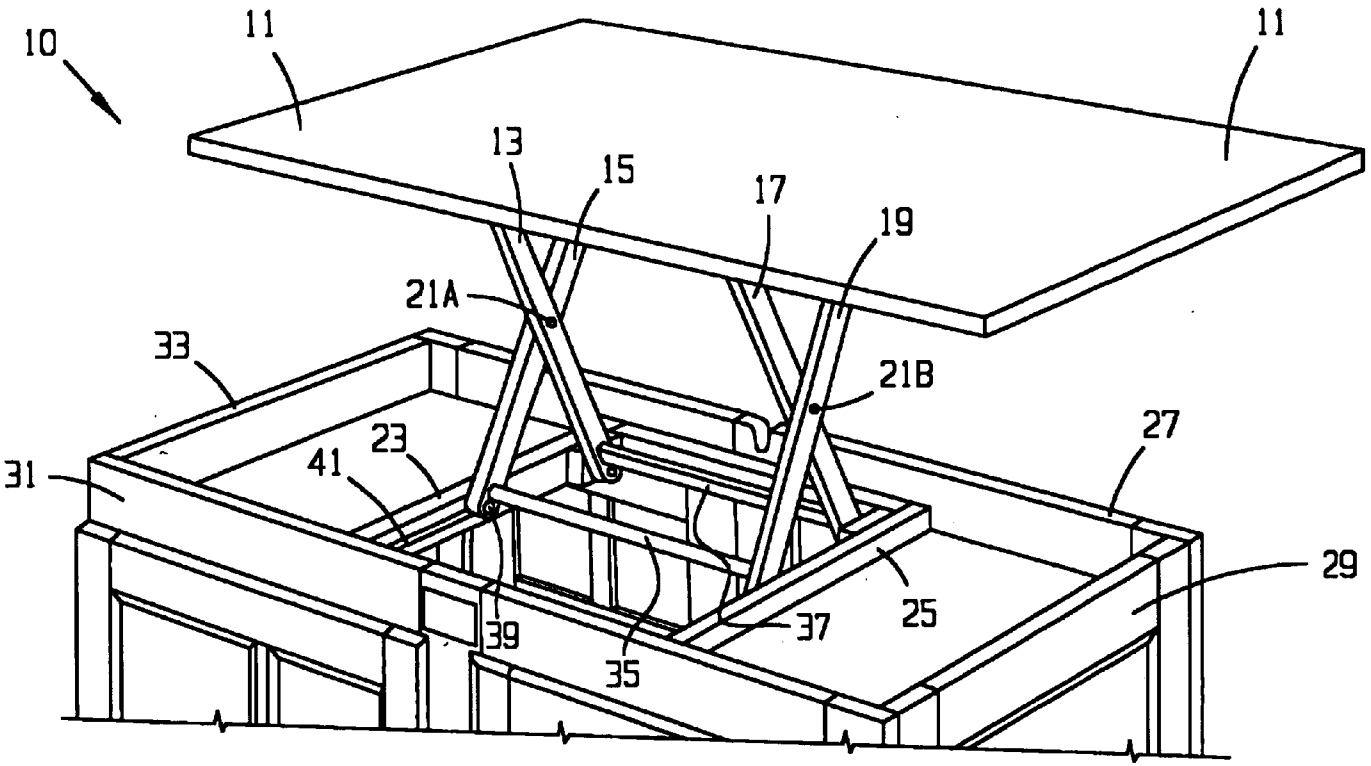
FIG. 1 is a perspective view of a height-adjustable table according to one form of the invention.

Referring to the drawings and initially to FIG. 1 there is shown a height-adjustable table assembly 10 according to the present invention. Such table assembly comprises a base portion that includes a first table top length support 27, first table top width support 29, second table top length support 31, and a second table top width support 33, disposed with respect to one another so that their edges form, generally, a planar rectangular construct upon which a flat, rectangular table top such as 11, may be caused to rest. However, the present invention differs from tables of the prior art in the fact that the table top 11 is readily height adjusted by the table's user, to accommodate various desired height settings by the user when altering the height of the table top 11 is deemed desirable or beneficial for a particular use.

The general mechanism by which a table top according to the invention is caused to be vertically adjustable is by means of a first sub-assembly comprising a first pivoting support 13 and second pivoting support 17, and a second sub-assembly comprising a first slidable pivoting support 15, and a second slidable pivoting support 19, disposed as shown, and wherein the first and second sub-assemblies are pivotally connected to one another at pivot points 21*a* and 21*b*. The lower portion of the first slidable pivoting support 15 is connected to the lower portion of the second slidable pivoting support 19 by means of lower slidable pivoting supports connector 35, and the end portions of these slidable pivoting supports are fitted with a guide pin 39 on their exterior faces, which guide pins ride inside a track portion 41 disposed on the first track member 23. There is a corresponding arrangement existing at the end portion of the second slidable pivoting support and the second track member 25. Additionally, there is a lower pivoting supports connector 37 disposed connectively between the lower end portions of the first pivoting support and the second pivoting support. In one preferred form of the invention, the first and second track members 23 and 25, respectively, are affixed using conventional means such as screws, nails, glue rivets, etc. to the first table top length support 27 and the second table top length support 31; however, equivalent structures are possible.

Figure 2:
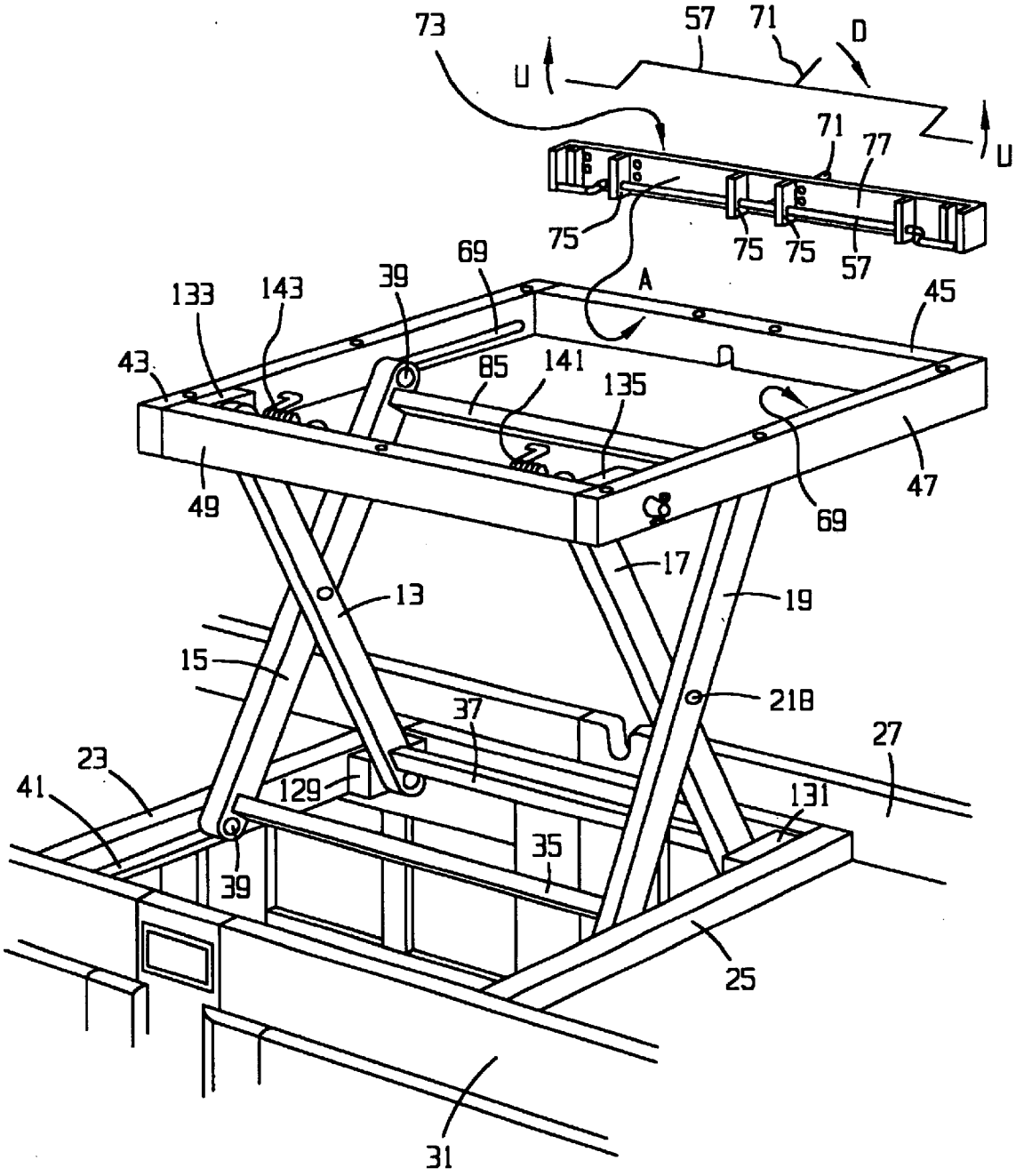
FIG. 2 is a perspective view of a mechanism useful for providing a height-adjustable table according to one form of the invention.

FIG. 2 shows the arrangement of the various connections between the elements of the pivoting support sub-assemblies about the top portion of a platen assembly to which the table top 11 is affixed in a table according to the invention. The platen comprises a first platen width support 43, a first platen length support 45, a second platen width support 47, and a second platen length support 49, all arranged so that one of their edge portions lie substantially in the same plane upon which table top portion 11 (FIG. 1) is intended to reside. The first platen width support 43 and second platen width support 47 are each provided with a linear slot 69 disposed on their faces which lie on the interior of the polygon comprising the platen assembly.

Shown again is the slidable pivoting support assembly which comprises the first slidable pivoting support 15 and second slidable pivoting support 19, connected at their upper ends by means of upper slidable pivoting supports connector 85, and at their lower ends by lower slidable pivoting supports connector 35.

There is also the pivoting support assembly which comprises the first pivoting support 13 and second pivoting support 17, connected at their upper ends by means of an upper pivoting supports connector 101 (FIG. 5), and at their lower ends by lower pivoting supports connector 37. The slidable pivoting support assembly and the slidable support assembly are connected to one another as shown at pivot points 21*a* and 21*b*.

Disposed at the lower end portions of the first slidable pivoting support 15 and second slidable pivoting support 19, and protruding from the outer face portions thereof there are guide pins 39 (FIG. 3) which reside in slidable arrangement within a linear slot 41 disposed in the face portion of the first track member, with identical features and relationship existing between a slot similarly disposed within the second track member 25 and a guide pin 39 at the lower end of the second slidable pivoting support 19. The upper ends of the first slidable pivoting support 15 and second slidable pivoting support 19 are connected to one another by means of upper slidable pivoting supports connector 85. Disposed at the upper end portions of the first slidable pivoting support 15 and second slidable pivoting support 19, and protruding from the outer face portions thereof there are guide pins (not shown) analogous to 39 which reside within the linear slot 69 of the first platen width support and a corresponding slot on the second platen width support 47.

The first pivoting support 13 and second pivoting support 17 of the pivoting support assembly are pivotally connected to the first track member 23 and second track member 25 at their lower ends, respectively, using conventional means such as screws, nails, etc. In one preferred form of the invention, spacer blocks 129 and 131 are disposed between the track members and the lower portions of the first and second pivoting supports to compensate for the thicknesses of the first and second slidable pivoting supports, and spacer blocks 133 and 135 are disposed between the upper ends of the first and second pivoting supports 13 and 17, and the first platen width support 43 and second platen width support 47. The first pivoting support 13 and second pivoting support 17 of the pivoting support assembly are pivotally connected to the first platen width support 43 and second platen width support 47 at their upper ends, respectively, using conventional means such as screws, nails, etc. In one preferred form of the invention, spacer blocks are disposed between the platen width supports and the upper portions of the first and second pivoting supports to compensate for the thicknesses of the first and second slidable pivoting supports.

Under such an arrangement as that described in this FIG. 2, the top planar surface of the platen assembly upon which the table top portion 11 is intended to rest is vertically moveable with respect to the plane formed by the edges of the table top length and width supports, i.e., the platen is height-adjustable. However, the forces of gravity acting on the scissoring assembly will lower the platen so that the common upper edges of its components, e.g., the first platen width support 43, first platen length support 45, second platen width support 47, and second platen length support 49, will be at the same level as the common upper edges of the first table top length support 27, first table top width support 29, second table top length support 31, and second table top width support 33, in the absence of a means for maintaining the platen at a desired height. The present invention provides such means for maintaining the platen at a desired height.

Also shown in FIG. 2 is the lock frame 73 which is useful in maintaining the platen at a desired height, in conjunction with other elements of the invention as yet to be described. The lock frame includes a plate portion 77 to which supports 75 are affixed by conventional means, and which supports contain the cammed control rod 57 having handle 71 in such a way that when the handle 71 is moved in a direction indicated by arrow labeled D, the cammed ends of the cammed control rod move in a direction indicated by the arrows labeled U. The plate 77 is mounted to the inside face of the first platen length support 45, as shown by arrow A.

Figure 3:
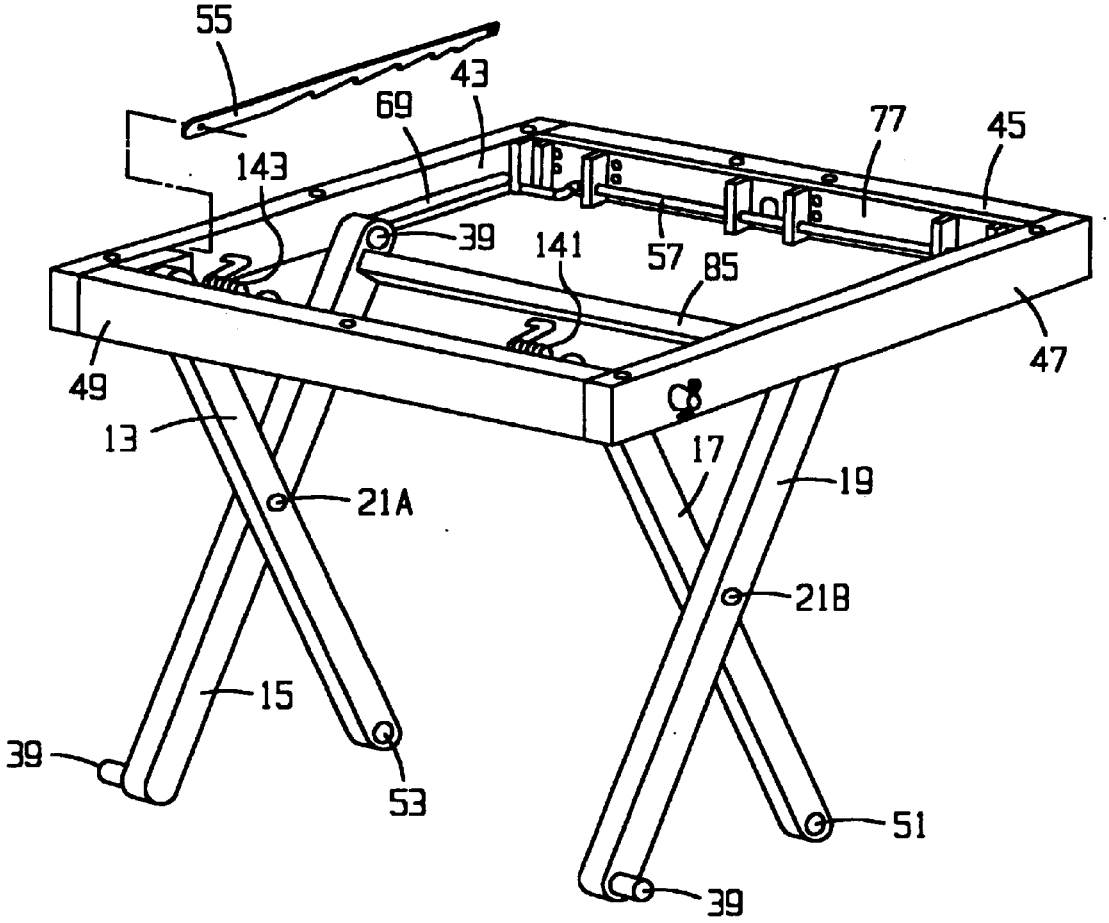
FIG. 3 is a perspective view of a portion of a mechanism useful for providing a height-adjustable table according to one form of the invention

In FIG. 3 is shown the platen, and some of the elements of the pivoting support assembly and the slidable pivoting support assembly, including the first platen width support 43, first platen length support 45, second platen width support 47, second platen length support 49, first pivoting support 13, first slidable pivoting support 15, second pivoting support 17, and second slidable pivoting support 19. The guide pins 39 are shown disposed at the lower ends of the first and second slidable pivoting supports 15 and 19 and protruding outward in a direction which enables them to reside within the linear slots 41 disposed in the interior face portions of the first track member 23 and second track member 25 (FIG. 1). Similarly, there are guide pins 39 disposed at the upper ends of the first and second slidable pivoting supports 15 and 19 and protruding outward in a direction which enables them to reside within the linear slots 41 disposed in the interior face portions of the first platen width support 43 and second platen width support 47. The plate 77 of the lock frame (73, FIG. 2) is affixed to the interior face of the first platen length support so that the end portion of the cammed control rod 57 is in the vicinity of the junction of the first platen width support 43 and the first platen length support 45. There is a toothed rod 55 which is pivotally affixed to the interior face portion of the first platen width support 43 using conventional fastening means. The toothed rod 55 is configured so that its toothed portions are adapted to ride on the guide pin 39 which is disposed at the top portion of the first slidable pivoting support 15. Preferably, the toothed rod is flat, and is disposed between the first slidable pivoting support 15 and the face of the first platen width support 43 as further shown in FIG. 4.

Figure 4:
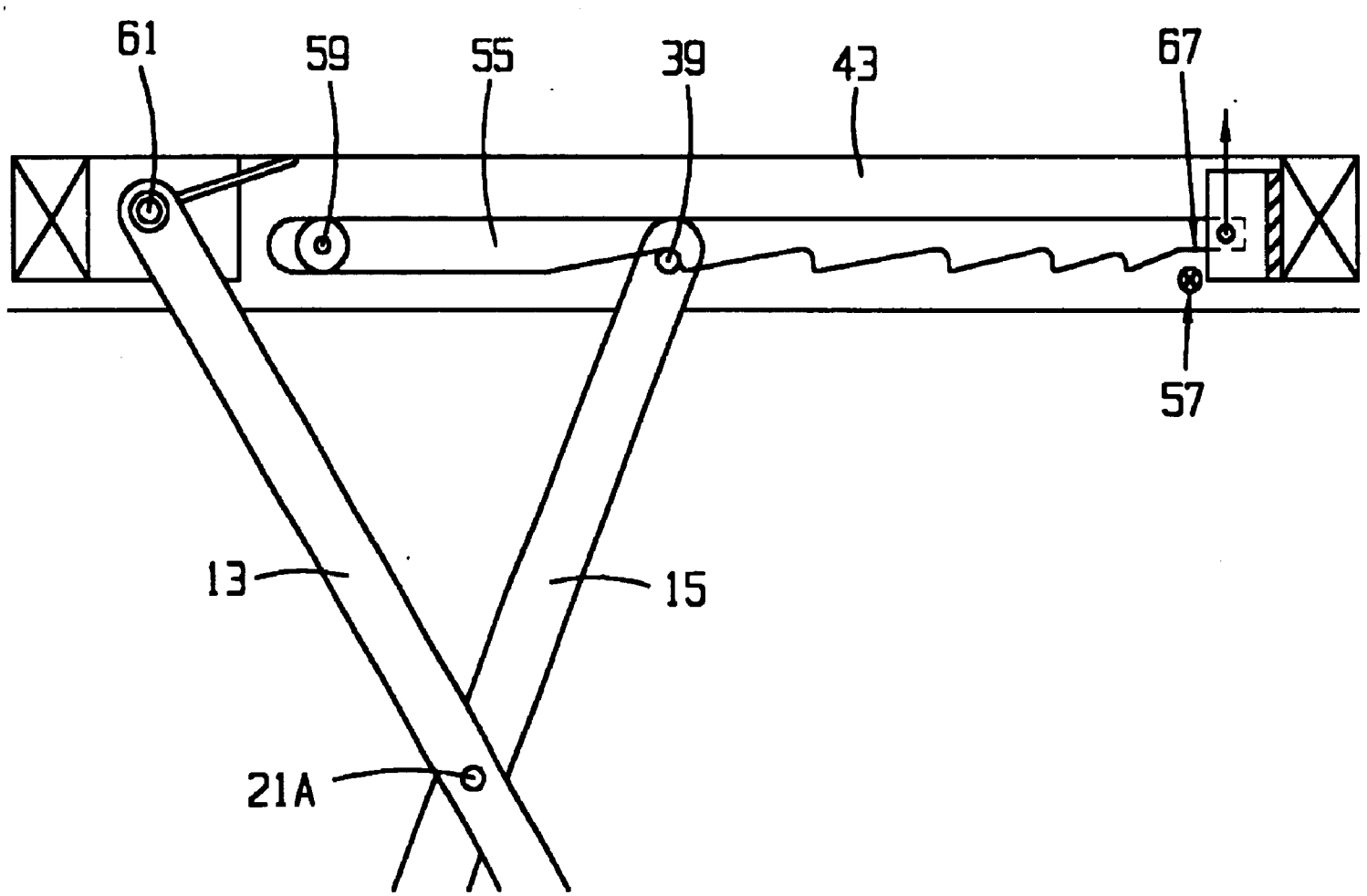
FIG. 4 is a side view of a locking mechanism useful for maintaining a table top at a selected height in accordance with one form of the present invention.

FIG. 4 is a side view of a means for maintaining the height of the platen of the present invention in a desired position, and shows the toothed rod 55 being pivotally attached at 59 to the interior face portion of the first platen width support 43. The first pivoting support 13 is shown pivotally connected to the first platen width support 43 at connection point 61, with spacer block 133 disposed between the upper end portion of the first pivoting support 13 and the interior face of the first platen width support 43. First slidable pivoting support 15 is shown pivotally attached to the first pivoting support 13 at pivot point 21*a*, and comprises a guide pin 39 which engages one of the depressions along the length of the toothed rod, thus maintaining the platen at a desired height. The end portion of the cammed control rod 57 is seen in sectional view, upon which the flat end portion 67 of the toothed rod rests, so that when the handle 71 (FIG. 2) is pushed in a downward direction, the end portion of the cammed control rod 57 exerts an upward force on the flat portion 67 of the toothed rod 55 in the direction of the arrow, thus disengaging the guide pin 39 from the depression in the toothed rod, enabling the first pivoting support and first slidable pivoting support to pivot about point 21*a* and thus enabling the height of the platen to be lowered.

Figure 5:
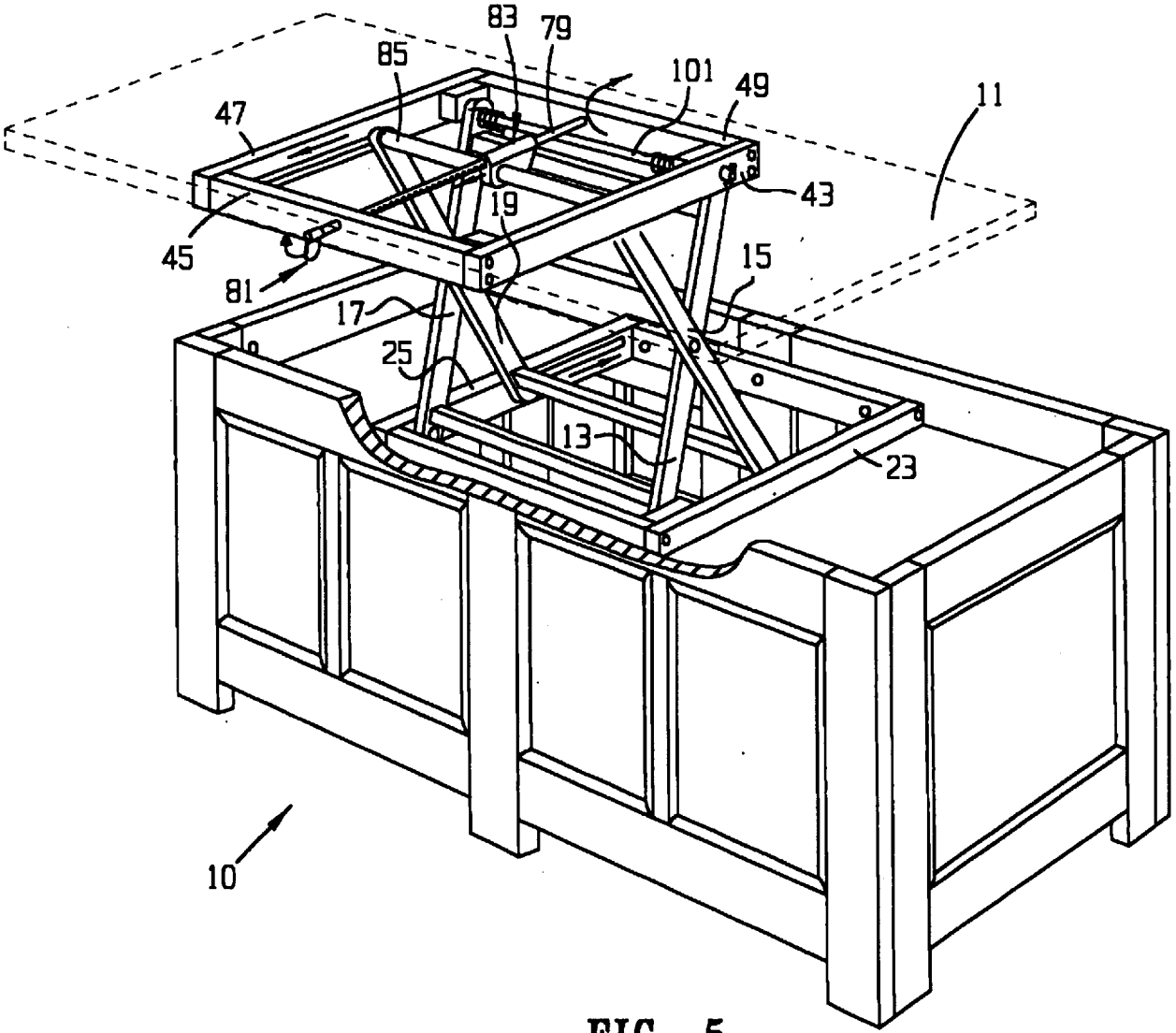
FIG. 5 is a perspective view of a height-adjustable table according to one form of the invention.
Figure 6:
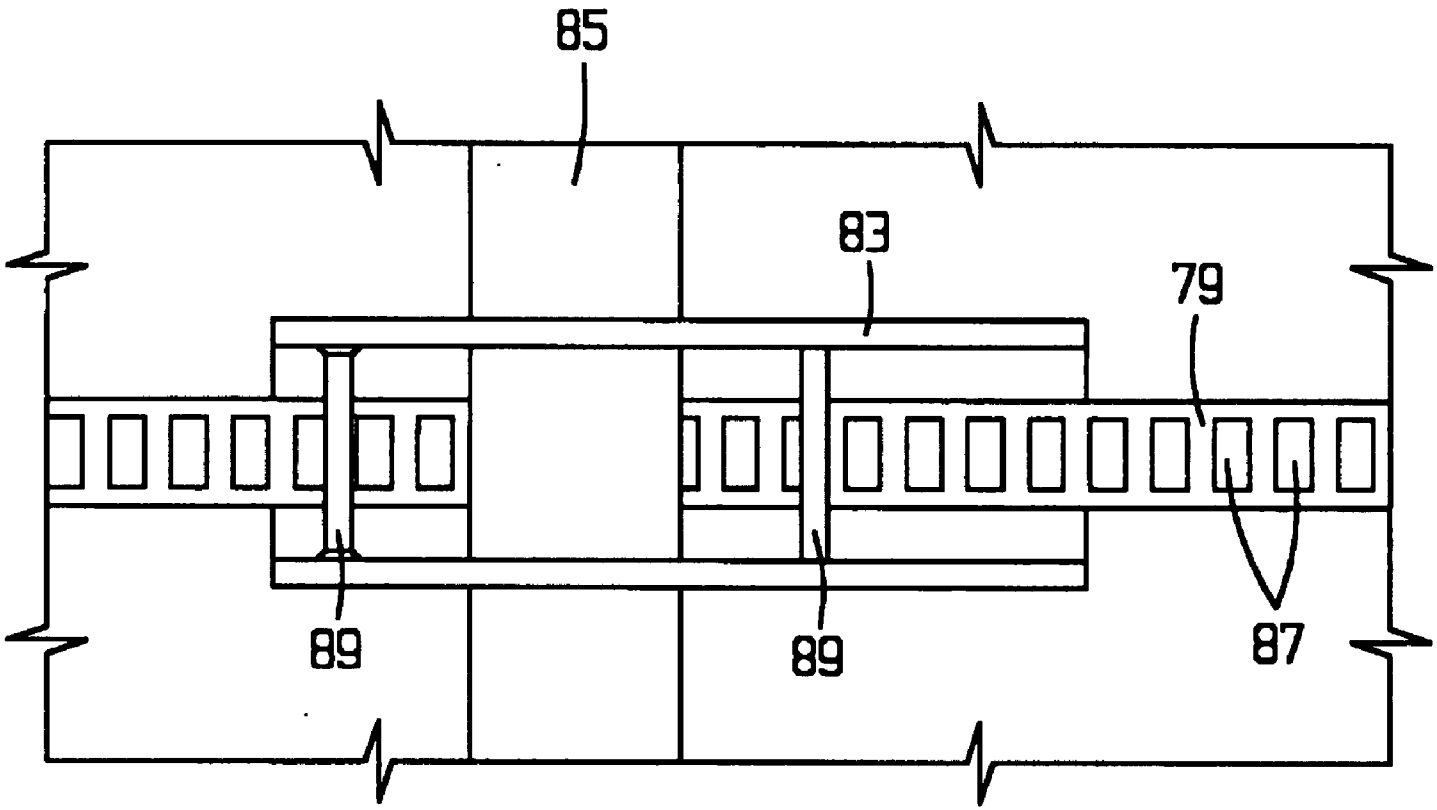
FIG. 6 is a bottom view of a clamping means useful in maintaining the table top portion of a table according to the invention in a selected height position.
Figure 7:
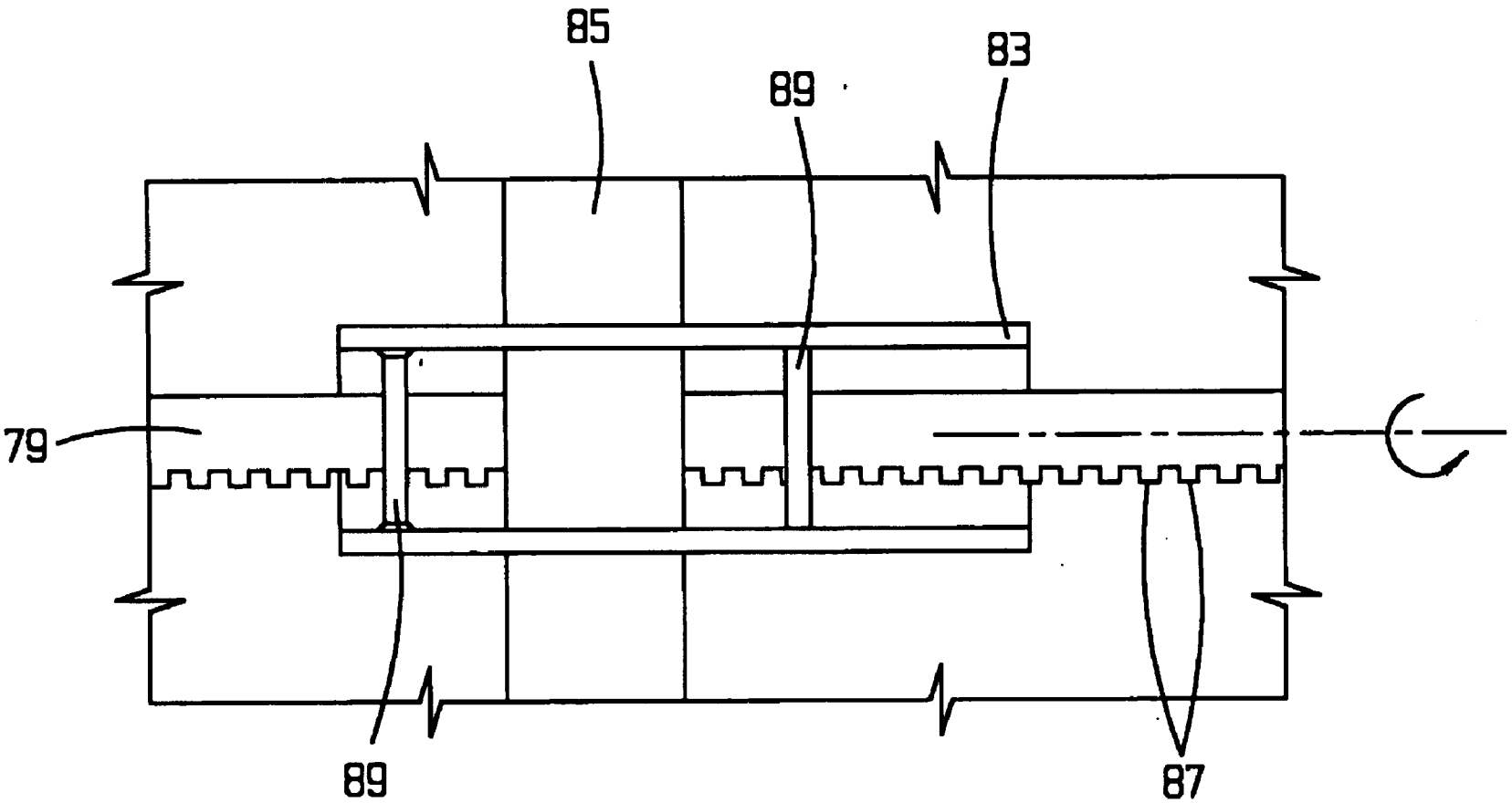
FIG. 7 is a bottom view of a clamping means useful in maintaining the table top portion of a table according to the invention in a selected height position.
Figure 8:
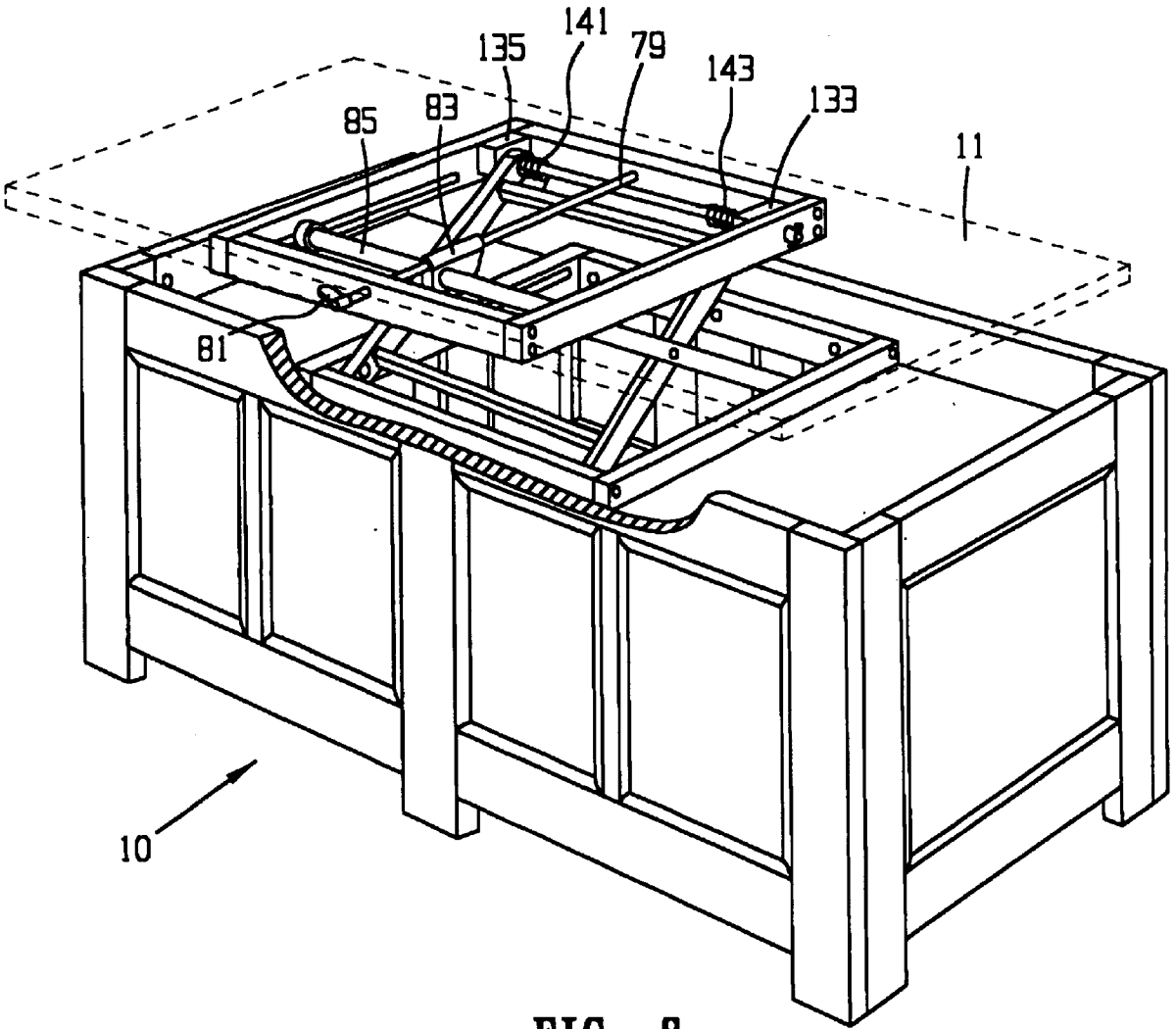
FIG. 8 is a perspective view of a height-adjustable table according to one form of the invention.

FIG. 5 shows another embodiment of the present invention having an alternative means for securing the platen portion in a desired location above the rest of the table 10 according to the invention. This alternative means includes a housing 83 disposed about and in mechanical contact with the upper slidable pivoting supports connector 75, and includes a provision for the passage therethrough of a second toothed rod 79 having a handle 81 disposed on one of its end portions. The second toothed rod 79 passes through the first platen length support 45 near the end portion having the handle 81, whilst the other end of the second toothed rod is pivotally engaged with or rotably connected to the interior face portion of the second platen length support 49, which may be by means of a dimple within the second platen length support, or other functionally equivalent alternative such as a bearing. Thus, the housing is disposed about the second toothed rod and the housing is simultaneously in rigid mechanical contact with the upper slidable pivoting supports connector. The housing includes a hollow channel space through which the toothed rod may be moved. The housing, comprising at least one cross bar oriented parallel to the upper slidable pivoting supports connector, causes the cross bar to be in sufficient position to engage the spaces between the teeth when the toothed rod is oriented with its teeth towards the cross bar so as to prevent motion of the toothed rod with respect to the upper slidable pivoting supports connector when the cross bar is engaged within a space between the teeth FIG. 6 shows an underside view of the housing 83 in the proximity of the second toothed rod 79, showing how the spaces between the teeth 87 on the second toothed rod 79 are disposed on both sides of cross bars 89 and in such position lateral movement of the guide pins 39 disposed at the ends of the first slidable pivoting support 15 and the second slidable pivoting support within the slots 69 is precluded, thus maintaining the platen portion as a whole in a desired vertical altitude. However, by rotation of the handle 81 by an amount of 90°, the teeth 87 are caused to be oriented perpendicularly to the cross bars 89, which, as shown in FIG. 7, permits adjustment of the vertical altitude of the platen portion, as shown in FIG. 8 as a non-limiting example of an embodiment in which the platen is lowered in its vertical altitude with respect to the position depicted earlier in FIG. 5.

Figure 9:
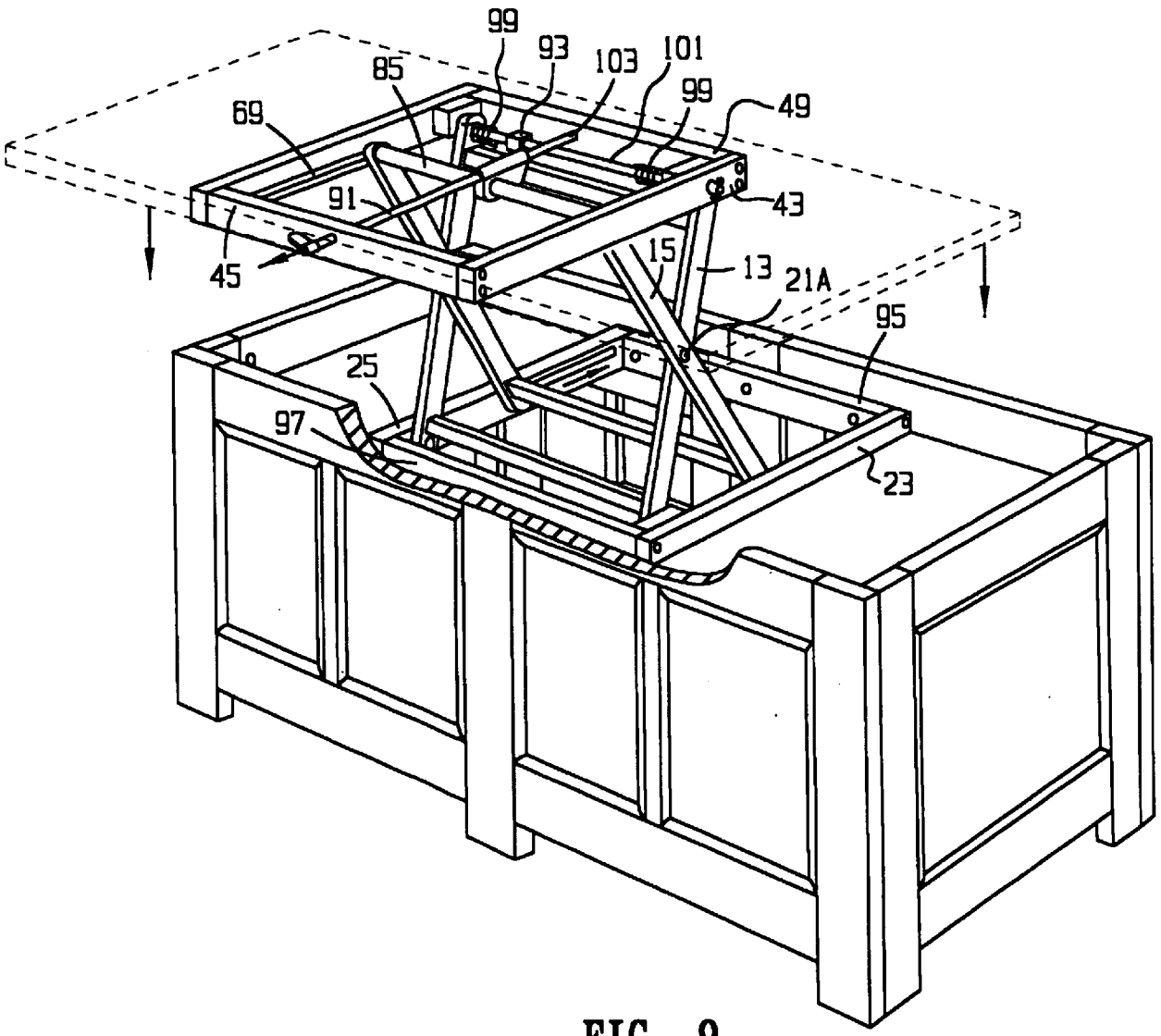
FIG. 9 is a perspective view of a height-adjustable table according to one form of the invention.

FIG. 9 shows another embodiment of the present invention having an alternative means for securing the platen portion in a desired location above the rest of the table 10 according to the invention. In this embodiment there is a clamp means 93 disposed about and in mechanical contact with the a bar 103 as more clearly shown in FIG. 10 in which the clamp means 93 is shown to be slidably disposed about the bar 103, which itself is in turn affixed to the upper slidable pivoting supports connector 85 by conventional means such as a weld W. The clamp means 93 comprises a base portion 111 having a plurality of holes 137 through which it is affixed to the table top portion 11 (FIG. 1), and a pair of slots disposed through its surface which slots are adapted to receive the end portions of the left locking tang 107 and right locking tang 109. There is a center support 121 affixed to the base portion 111 in a perpendicular orientation, and the right and left locking tangs and center support all contain holes through them which is adapted to enable the bar 103 of circular cross-section to be passed through each of these elements in a finished construct according to the invention. There is also a stop 113 positioned as shown, whose function is to limit the movement of the right and left locking tangs. Control rod 91 is shown attached to the lever control arm 119, which itself is shown to be connected to the right locking tang 109 by means of the first connector lever 115. Thus, pulling on control rod 91 towards the left in FIG. 10 ultimately causes the right locking tang to be adjusted to a position which is more perpendicular to the base portion 111 than instantly shown in FIG. 10, thus relieving the interference grasp exerted by the right locking tang on the bar 103 and thus enabling the bar 103 to slide freely through the clamping means 93. Springs 105 function to mechanically bias the right and left locking tangs 107 and 109 towards the positions depicted in FIG. 10, with said locking tangs providing interference resistance to the motion of the bar 103 when in the orientation shown. Moving the control rod 91 to the left in FIG. 10 relieves the interference and enables the sliding of the bar 103 through the clamping means 93, which by virtue of the bar 103 being connected to the upper slidable pivoting supports connector 85, enables up and down adjustment of the altitude of a table top portion 11 which is affixed to the base portion 111 of the clamping means 93, as shown in cross section in FIG. 11. Here, the table top 11 is shown held in place against the base portion 11 of the clamping means 93 by means of screws 123. The control rod 91 is in contact with the right and left locking tangs (109 and 107) by means of the first connector lever 115 and second connector lever 117, the arrangement of which is more clearly shown in FIG. 12 subsequent. FIG. 11 shows a spacer 12 disposed about the fastening means 139 to enable smooth motion of the elements comprising the clamping means, which are generally flat pieces of metal having holes through their surfaces at the points of connection to the remaining elements of this clamping means. The connections between the elements are made using conventional fasteners, and are sufficiently loose to enable smooth pivoting of the various elements with respect to one another.

Figure 11:
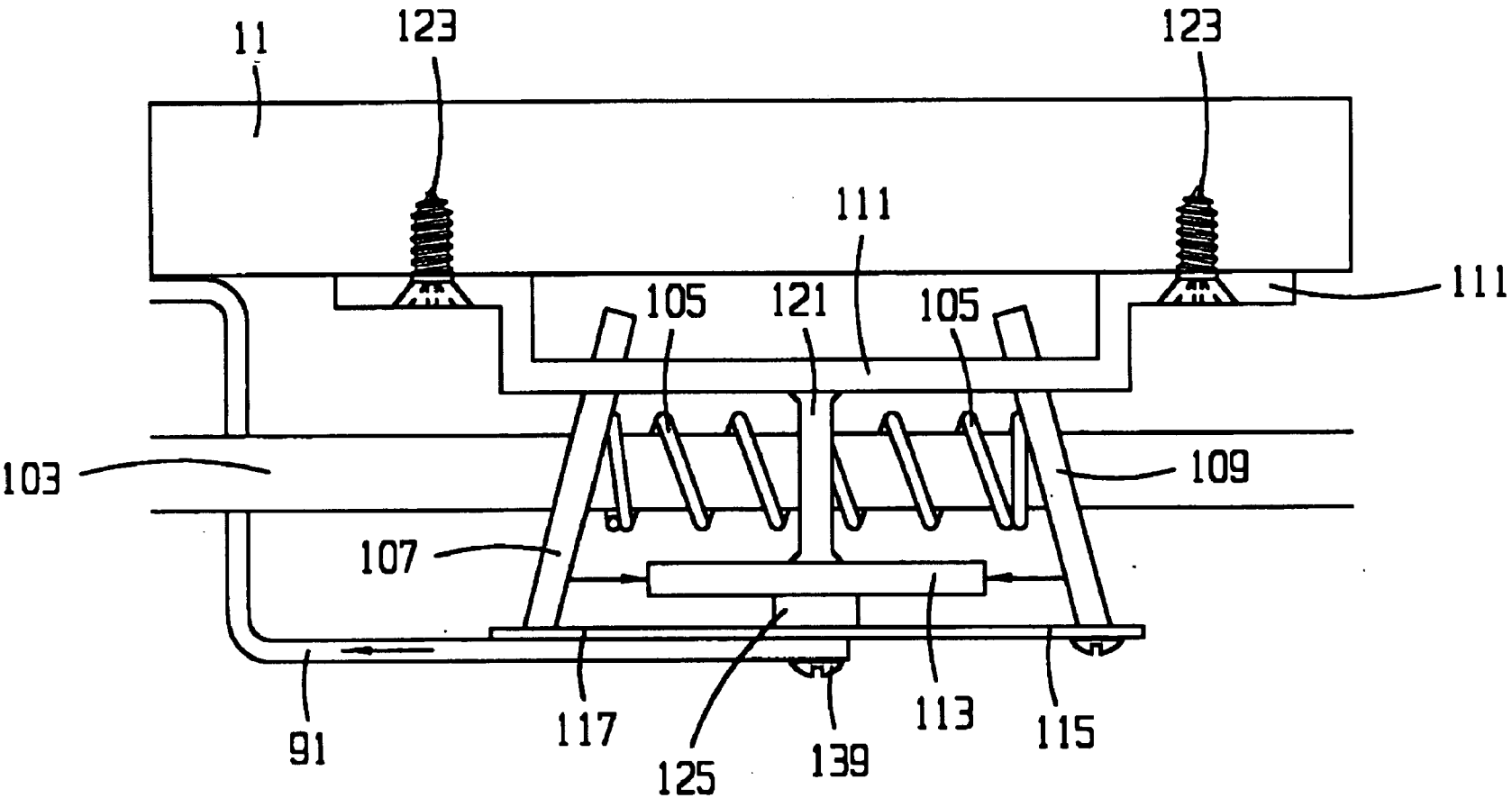
FIG. 11 is a side view of a clamping means useful in maintaining the table top portion of a table according to the invention in a selected height position
Figure 12:
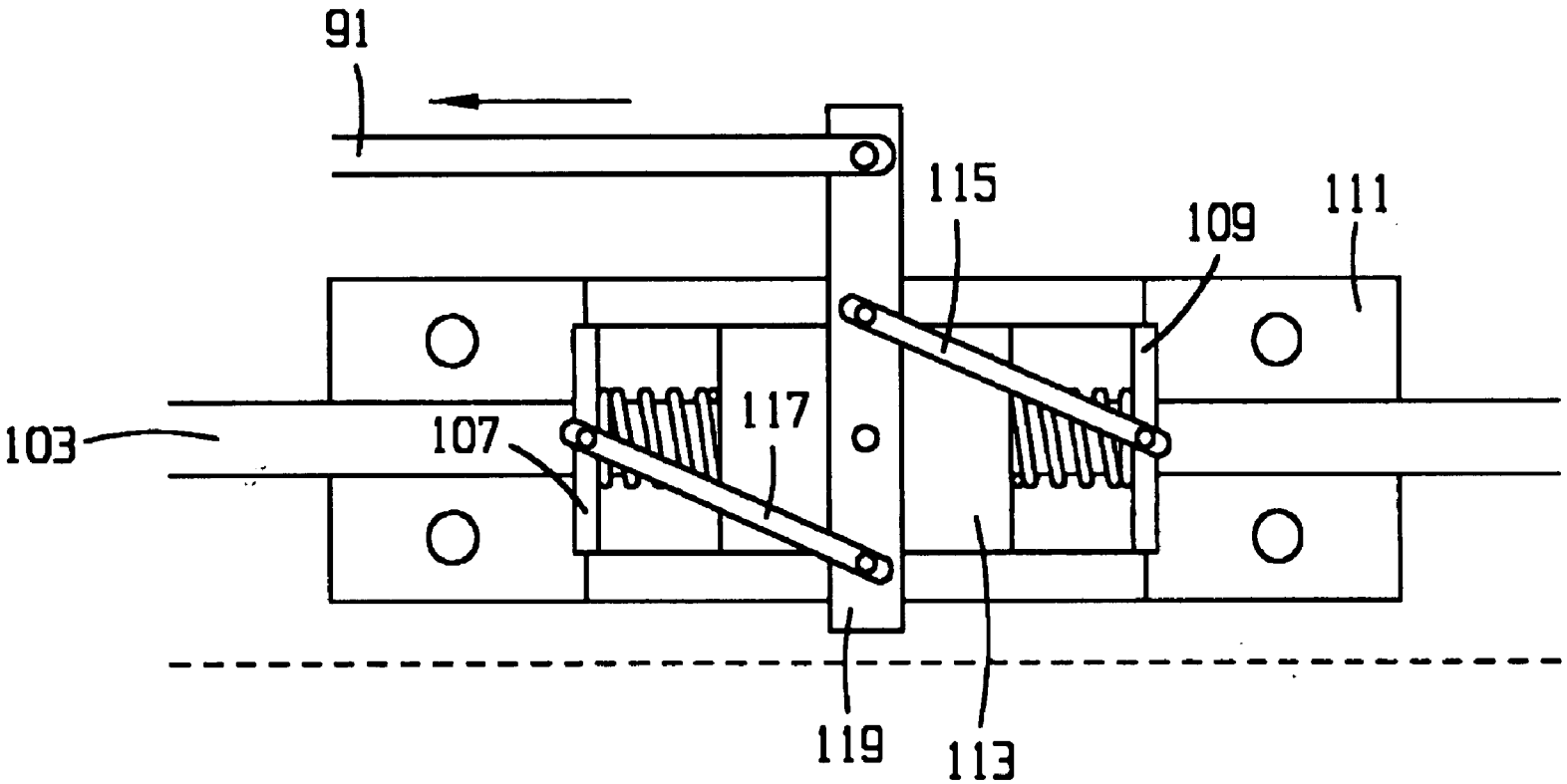
FIG. 12 is a bottom view of a clamping means useful in maintaining the table top portion of a table according to the invention in a selected height position

FIG. 12 is a bottom view of the clamping means 93 which more clearly shows the arrangement of the various elements of the clamping means including the base portion 111, control rod 91, lever control arm 119, first and second connector levers 115 and 117 respectively, left and right locking tangs 107 and 109, and bar 103. Thus, FIGS. 10, 11, and 12 show a clamping means 93 according to one preferred form of the invention in a locked position disposed about the bar 103.

Figure 10:
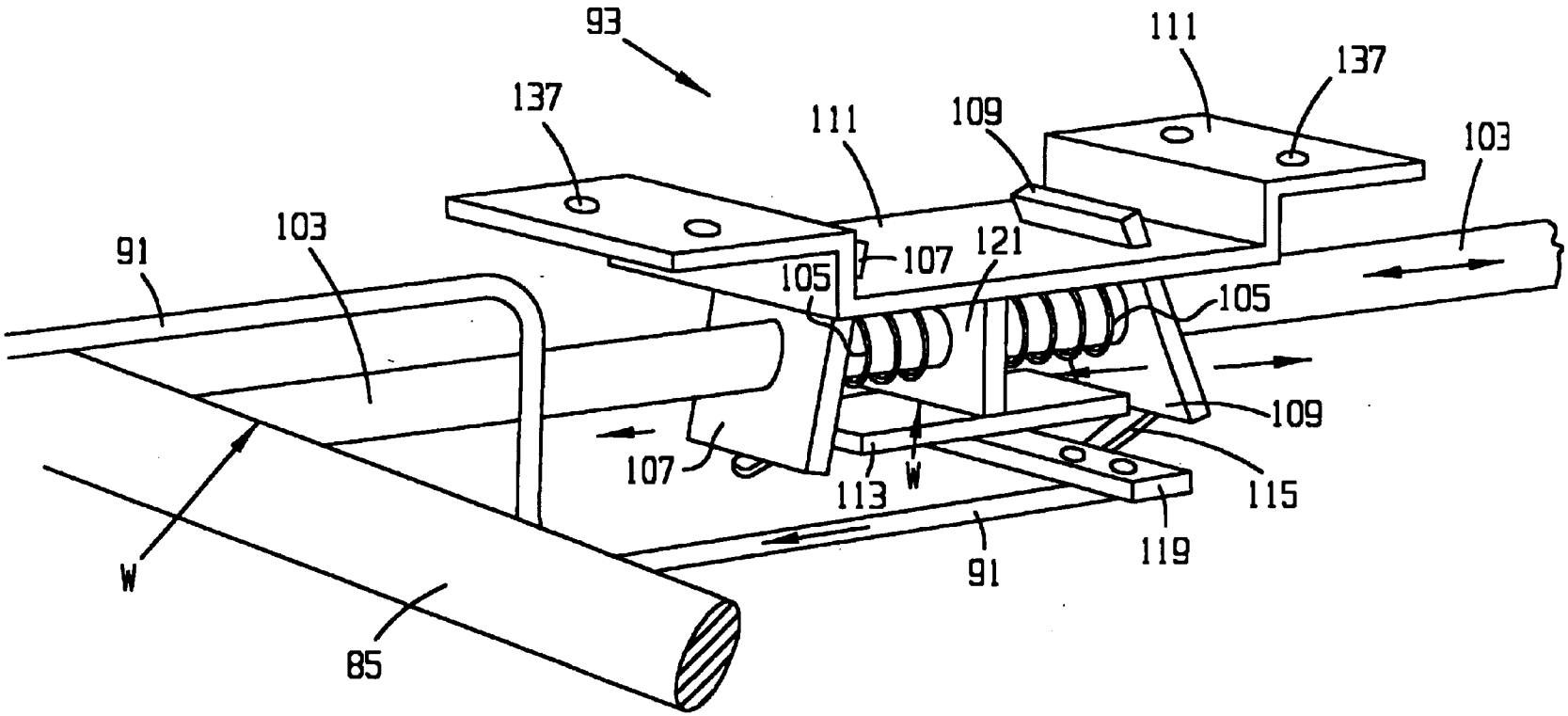
FIG. 10 is a perspective view of a clamping means useful in maintaining the table top portion of a table according to the invention in a selected height position
Figure 13:
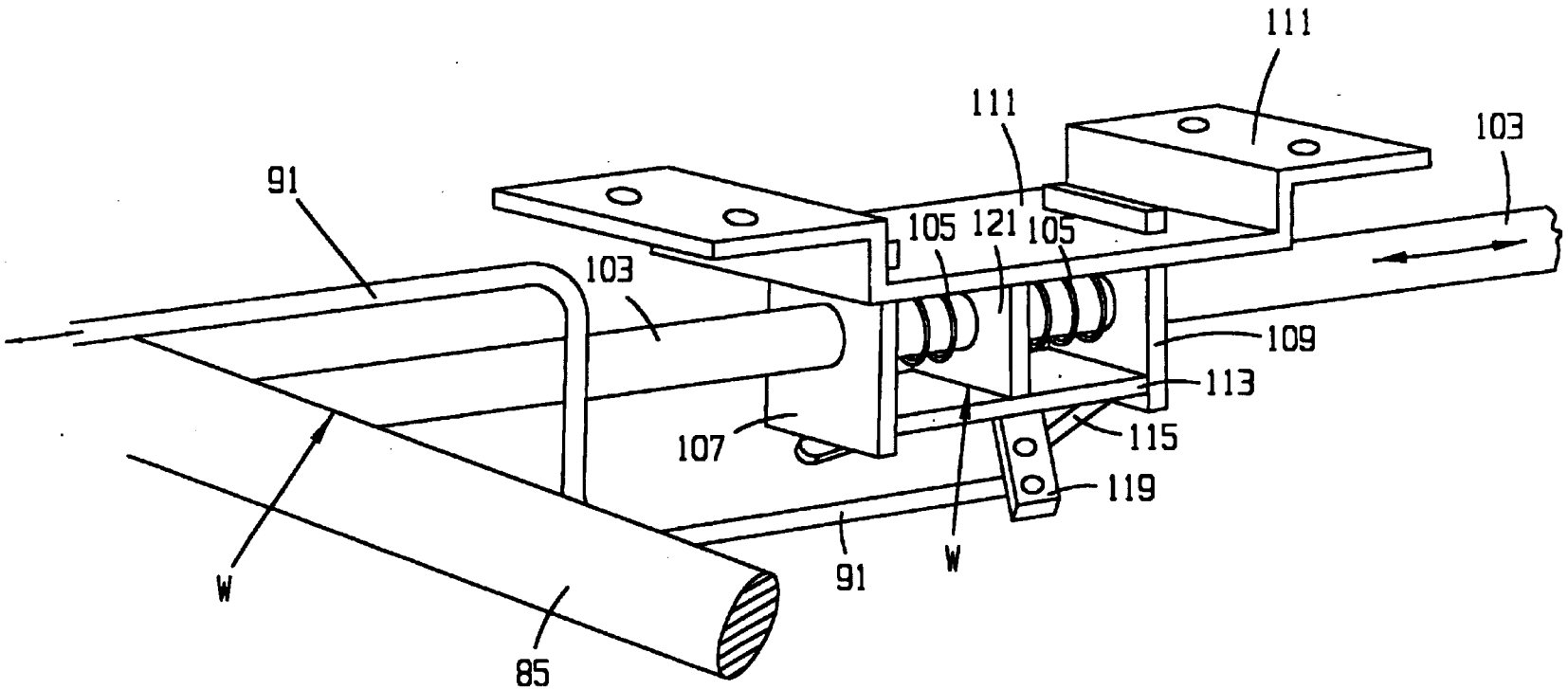
FIG. 13 is a perspective view of a clamping means useful in maintaining the table top portion of a table according to the invention in a selected height position
Figure 14:
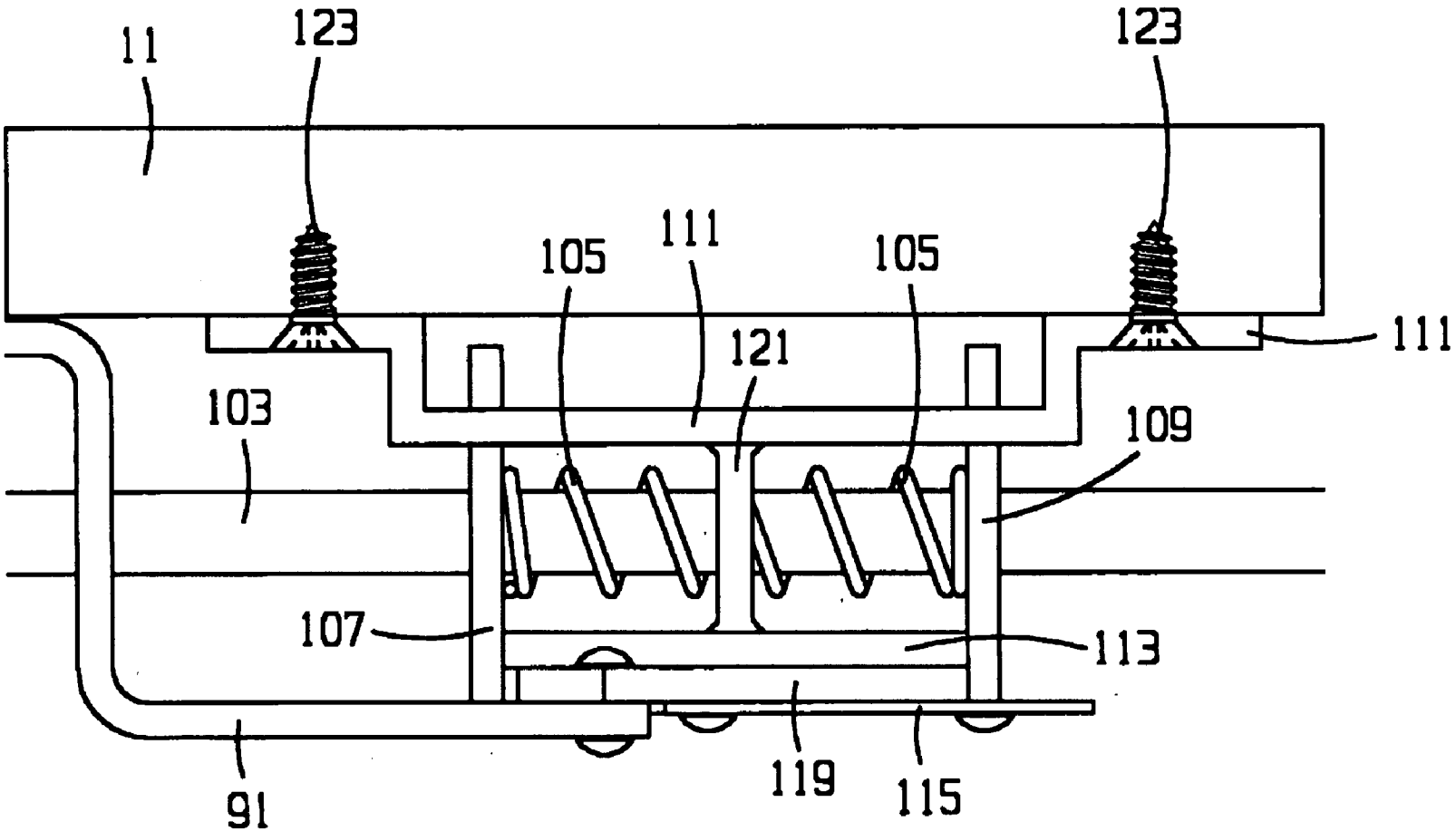
FIG. 14 is a side view of a clamping means useful in maintaining the table top portion of a table according to the invention in a selected height position
Figure 15:
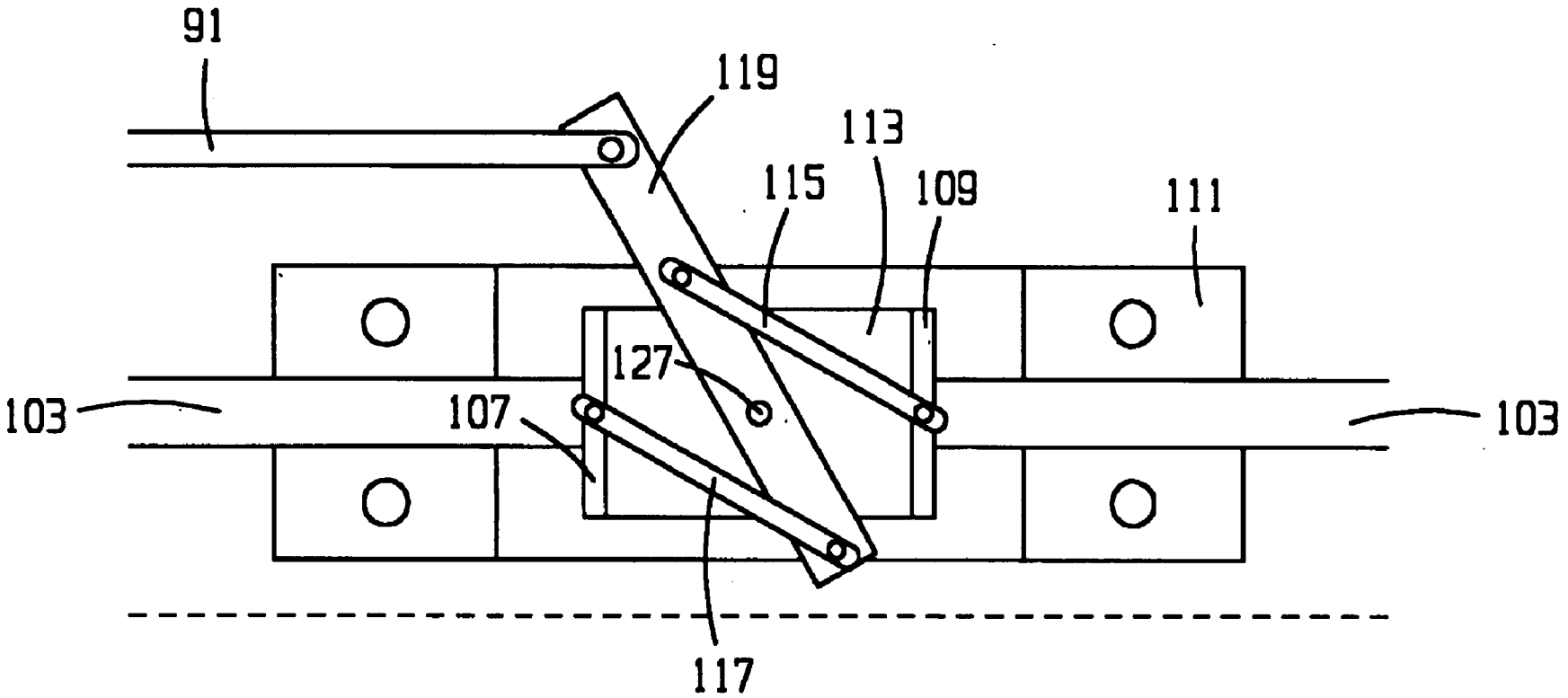
FIG. 15 is a bottom view of a clamping means useful in maintaining the table top portion of a table according to the invention in a selected height position.

FIGS. 13, 14, and 15, on the other hand, show the same views as for FIGS. 10, 11, and 12 previously, however, with the exception that the control rod 91 has now been pulled towards the left direction in FIG. 10, and thus the views of FIGS. 13, 14, and 15 are those showing the clamping means in the non-locked position about the bar 103 in which the bar 103 is enabled to slide through the clamping means, and thus to enable the vertical altitude of the table top 11 affixed to the base portion 111 to be adjusted to a desired level. By providing a table according to the invention having such a clamping means and with easy access to the control rod 91, a possessor of such a table can readily adjust the vertical height of the table.

According to one preferred embodiment of the present invention, there are springs 141 and 143 located at the end portions of and disposed about the upper pivoting supports connector 101 (FIGS. 2,3, 8). These springs are coiled about the upper pivoting supports connectors and each have two arms, one of which is in each case in contact with the spacer blocks 133, 135 and the other of which in each case is in contact with the second platen length support 49. Springs 141 and 143 and are in a most compressed position when the platen is in its lowermost position, that is, as the platen is raised, the potential energy stored in the springs decreases. Such a feature reduces the force which a person must exert when raising or lowering the platen and makes use of a table according to the invention a very light task.

Connections between the various elements of a table according to the present invention are made using conventional fastening means, such as glue, wood screws, sheet metal screws, rivets, welds, etc.

A table according to the present invention appears as any other table having a flat top, because the mechanisms for adjustment of the table top altitude with respect to the frame, or base portion, to which it is ultimately attached are concealed beneath the table top portion 11. A table according to the invention is simple to use. Once supplied and placed into the position within a room at which it is desired to be located, a person desiring to raise the height of the table top portion 11 merely disengages the particular means for maintaining the platen at a selected height above said top portion of said base portion, and lifts or permits the table top portion 11 to be raised or lowered into a desired position, at which point the means for maintaining the platen at a selected height is returned to its locked position. Such means have been described herein as those embodied in the various figures. However, consideration must be given to the fact that although this and other features of the present invention have been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow at the end of this specification.

The materials from which a table according to the present invention may be constructed include those materials recognized by those skilled in the art of building furniture and other fixtures, and include without limitation various woods, plastics, polymers, composites, metals, alloys, conglomerates, particle boards, masonite, plywood, glass, etc.

A table made in accordance with the present invention has many potential uses, including use as a game table during the play of a game such as chess, in which it is desired to raise the level of the game board. In such regard, a table according to the invention may be a coffee table. Another employment for a table according to the invention is as an examination table for animals within a veterinary medicine practice, to adjust the height of the plane upon which an animal is disposed during an examination or surgical process. Of course a table according to the invention may also be used by surgeons who operate on human patients, within a hospital setting. Accordingly, for convenience, the present invention contemplates the use of mechanized motion for altering the height of the platen portion with respect to the base portion of a table according to the invention, such as motors and gears, etc. for automating the raising and lowering of the platen portion.

What is claimed is:

1. A height-adjustable table comprising:

a) a base portion having length, width, and height dimensions, and comprising a top portion, bottom portion, two face portions, and two end portions;

b) a track means disposed on the top portion of said base portion, wherein said track means comprises a first linear track member and a second linear track member, wherein said track members are oriented parallel to one another, and wherein said first linear track member and said second linear track member are each oriented in a parallel configuration with respect to said width dimension of said base portion, and wherein each of said track members include a slot, wherein the slot on said first linear track member and the slot on said second linear track member are oriented in a parallel configuration with respect to one another;

c) a scissoring support means which comprises:

i) a linear first pivoting support having an upper end portion and a lower end portion;

ii) a linear first slidable pivoting support having an upper end portion and a lower end portion;

iii) a linear second pivoting support having an upper end portion and a lower end portion;

iv) a linear second slidable pivoting support having an upper end portion and a lower end portion;

wherein said first pivoting support and said second pivoting support are connected to one another at their upper end portions by means of a linear upper pivoting support connector, and wherein said first pivoting support and said second pivoting support are connected to one another at their lower end portions by means of a linear lower pivoting support connector, and wherein said first slidable pivoting support and said second slidable pivoting support are connected to one another at their upper end portions by means of a linear upper slidable pivoting support connector, and wherein said first slidable pivoting support and said second slidable pivoting support are connected to one another at their lower end portions by means of a linear lower slidable pivoting support connector, said first pivoting support and said first slidable pivoting support being pivotally connected to one another at a point along their lengths, and said second pivoting support and said second slidable pivoting support being pivotally connected to one another at a point along their lengths, said first and second slidable pivoting supports each have a pin disposed at their lower end portions which pins are adapted to slidably reside in said slots of said linear track members, d) a platen which comprises a first platen width support, a first platen length support, a second platen width support, and a second platen length support, wherein said width supports are oriented parallel to one another, said first platen width support and said second platen width support each including a slot disposed in their face portion which faces the interior space between them, said platen being hingedly connected to the upper end portions of said first pivoting support and said second pivoting support, and wherein said first and second slidable pivoting supports each further comprise a pin disposed at their upper end portions, which pins each reside within said slots disposed in the face portions of said first platen width support and said second platen width support;

e) a table top portion, said table top portion being attached to said platen by connection to at least one of said first platen width support, said first platen length support, said second platen width support, and said second platen length support; and f) a means for maintaining said platen at a selected height above said top portion of said base portion.

2. A table according to claim 1 further comprising a spring located at the end portion of, and disposed about the upper pivoting support connector in such a way as to be coiled about the upper pivoting supports connector, said spring having two arms, one of which arms is in each case in contact with a spacer blocks disposed between a pivoting support and a platen width support and the other arm of which is in contact with a second platen length support, so as to reduce the force required to raise or lower the platen portion with respect to the base portion.

3. A table according to claim 1 wherein said means for maintaining said platen at a selected height above said top portion of said base portion comprises:

a) a toothed rod having a plurality of teeth with spaces between said teeth and which toothed rod is pivotally attached to the face portion of said first platen width support upon which said slot is disposed;

b) a cammed control rod having a first end portion and a second end portion, said cammed control rod being pivotally attached to said first platen length support such that said first end portion of said cammed control rod is in contact with said toothed rod wherein said toothed rod is disposed so that said pin which is disposed on said upper end portion of said first slidable pivoting support is adapted to be engageable with at least one of the spaces between said teeth of said toothed rod.

4. A height-adjustable table comprising:

a) a base portion having length, width, and height dimensions, and comprising a top portion, bottom portion, two face portions, and two end portions;

b) a track means disposed on the top portion of said base portion, wherein said track means comprises a first linear track member and a second linear track member, wherein said track members are oriented parallel to one another, and wherein each of said track members include a slot, wherein the slot on said first linear track member and the slot on said second linear track member are oriented in a parallel configuration with respect to one another;

c) a scissoring support means which comprises:

i) a linear first pivoting support having an upper end portion and a lower end portion;

ii) a linear first slidable pivoting support having an upper end portion and a lower end portion;

iii) a linear second pivoting support having an upper end portion and a lower end portion;

iv) a linear second slidable pivoting support having an upper end portion and a lower end portion;

wherein said first pivoting support and said second pivoting support are connected to one another at their upper end portions by means of a linear upper pivoting support connector, and wherein said first pivoting support and said second pivoting support are connected to one another at their lower end portions by means of a linear lower pivoting support connector, and wherein said first slidable pivoting support and said second slidable pivoting support are connected to one another at their upper end portions by means of a linear upper slidable pivoting support connector, and wherein said first slidable pivoting support and said second slidable pivoting support are connected to one another at their lower end portions by means of a linear lower slidable pivoting support connector, said first pivoting support and said first slidable pivoting support being pivotally connected to one another at a point along their lengths, and said second pivoting support and said second slidable pivoting support being pivotally connected to one another at a point along their lengths, said first and second slidable pivoting supports each have a pin disposed at their lower end portions which pins are adapted to slidably reside in said slots of said linear track members, d) a platen which comprises a first platen width support, a first platen length support, a second platen width support, and a second platen length support, wherein said width supports are oriented parallel to one another, said first platen width support and said second platen width support each including a slot disposed in their face portion which faces the interior space between them, said platen being hingedly connected to the upper end portions of said first pivoting support and said second pivoting support and wherein said first and second slidable pivoting supports each further comprise a pin disposed at their upper end portions, which pins each reside within said slots disposed in the face portions of said first platen width support and said second platen width support;

e) a table top portion, said table top portion being attached to said platen by connection to at least one of said first platen width support, said first platen length support, said second platen width support, and said second platen length support; and f) a means for maintaining said platen at a selected height above said top portion of said base portion, comprising:

i) a toothed rod which is substantially circular in cross-section having a first end portion and a second end portion, said first end portion including a handle means, and wherein said toothed rod further includes a plurality of teeth on its outer surface having spaces between said teeth, said toothed rod being disposed through said first platen length support and rotably attached at its second end portion to said second platen length support;

ii) a housing which is disposed about said toothed rod and which housing is simultaneously in rigid mechanical contact with said upper slidable pivoting supports connector, said housing including a hollow channel space through which said toothed rod may be moved, and wherein said housing comprises at least one cross bar oriented parallel to said upper slidable pivoting supports connector, which cross bar is in sufficient position to engage the spaces between said teeth when said toothed rod is oriented with its teeth towards said cross bar so as to prevent motion of said toothed rod with respect to said upper slidable pivoting supports connector when said cross bar is engaged within a space between said teeth.

5. A height-adjustable table comprising:

a) a base portion having length, width, and height dimensions, and comprising a top portion, bottom portion, two face portions, and two end portions;

b) a track means disposed on the top portion of said base portion, wherein said track means comprises a first linear track member and a second linear track member, wherein said track members are oriented parallel to one another, and wherein each of said track members include a slot, wherein the slot on said first linear track member and the slot on said second linear track member are oriented in a parallel configuration with respect to one another;

c) a scissoring support means which comprises:

i) a linear first pivoting support having an upper end portion and a lower end portion;

ii) a linear first slidable pivoting support having an upper end portion and a lower end portion;

iii) a linear second pivoting support having an upper end portion and a lower end portion;

iv) a linear second slidable pivoting support having an upper end portion and a lower end portion;

wherein said first pivoting support and said second pivoting support are connected to one another at their upper end portions by means of a linear upper pivoting support connector, and wherein said first pivoting support and said second pivoting support are connected to one another at their lower end portions by means of a linear lower pivoting support connector, and wherein said first slidable pivoting support and said second slidable pivoting support are connected to one another at their upper end portions by means of a linear upper slidable pivoting support connector, and wherein said first slidable pivoting support and said second slidable pivoting support are connected to one another at their lower end portions by means of a linear lower slidable pivoting support connector, said first pivoting support and said first slidable pivoting support being pivotally connected to one another at a point along their lengths, and said second pivoting support and said second slidable pivoting support being pivotally connected to one another at a point along their lengths, said first and second slidable pivoting supports each have a pin disposed at their lower end portions which pins are adapted to slidably reside in said slots of said linear track members, d) a platen which comprises a first platen width support, a first platen length support, a second platen width support, and a second platen length support, wherein said width supports are oriented parallel to one another, said first platen width support and said second platen width support each including a slot disposed in their face portion which faces the interior space between them, said platen being hingedly connected to the upper end portions of said first pivoting support and said second pivoting support, and wherein said first and second slidable pivoting supports each further comprise a pin disposed at their upper end portions, which pins each reside within said slots disposed in the face portions of said first platen width support and said second platen width support;

e) a table top portion, said table top portion being attached to said platen by connection to at least one of said first platen width support, said first platen length support, said second platen width support, and said second platen length support; and f) a means for maintaining said platen at a selected height above said top portion of said base portion, comprising:

a) a bar having a first end portion and a second end portion, said first end portion attached to said upper slidable pivoting supports connector;

b) a locking means comprising:

i) a base portion, said base portion including a first slot and a second slot through its surface;

ii) a center support having a first end portion and a second end portion, wherein said first end portion of said center support is attached to said base portion, said center support comprising a hole therethrough;

iii) a stop portion attached to said second end portion of said center support;

iv) a first locking tang having a first end portion and a second end portion, and comprising a hole therethrough, wherein said first end portion of said first locking tang is disposed within said first slot of said base portion;

v) a second locking tang having a first end portion and a second end portion, and comprising a hole therethrough, wherein said first end portion of said second locking tang is disposed within said second slot of said base portion;

said rod being disposed through said holes in said center support, said first locking tang, and said second locking tang, vi) a first spring and a second spring, wherein said first spring is disposed about said rod in a position between said first locking tang and said center support, and wherein said second spring is disposed about said rod in a position between said second locking tang and said center support;

vii) a lever control arm having a first end portion and a second end portion, which lever control arm is pivotally attached to said stop;

viii) a first connector lever having a first end portion and a second end portion, which first connector lever is pivotally attached at its first end portion to said second end portion of said first locking tang, and wherein said first connector lever is pivotally attached at its second end portion to said lever control arm at a point between said first end portion of said lever control arm and the point at which said lever control arm is pivotally attached to said stop;

ix) a second connector lever having a first end portion and a second end portion, which second connector lever is pivotally attached at its first end portion to said second end portion of said second locking tang, and wherein said second connector lever is pivotally attached at its second end portion to said second end portion of said lever control arm;

x) a control rod having a first end portion and a second end portion, wherein said first end portion of said control rod is pivotally attached to said first end portion of said lever control arm, and wherein said second end portion of said lever control arm passes through the first platen length support, so that a back and forth movement of said second end of said control rod causes said first locking tang and said second locking tang to pivot within said slots on said base, thus effecting a change in the degree of freedom which said locking means may slide about said bar, and wherein said base portion is attached to said table top.

* * * * *